US006159676A

United States Patent [19]

Lin et al.

[11] Patent Number: 6,159,676

[45] Date of Patent: Dec. 12, 2000

[54] CHEMICAL SENSITIZATION OF LARGE TABULAR GRAIN EMULSIONS

[75] Inventors: Ming Jye Lin, Penfield; Kenneth J. Lushington, Rochester; Frederick C. Derks, Rochester; Joseph C. Deaton, Rochester, all of N.Y.

[73] Assignee: Eastman Kodak Company, Rochester, N.Y.

[21] Appl. No.: 08/985,532

[22] Filed: Dec. 5, 1997

[51] Int. Cl.[7] ..... G03C 1/035; G03C 1/09

[52] U.S. Cl. ..... 430/567; 430/603; 430/605

[58] Field of Search ..... 430/603, 567, 430/569, 605

[56] References Cited

U.S. PATENT DOCUMENTS

| | | | |
|---|---|---|---|
| 4,810,626 | 3/1989 | Burgmaier et al. | 430/569 |
| 5,049,485 | 9/1991 | Deaton | 430/605 |
| 5,503,970 | 4/1996 | Olm et al. | 430/567 |
| 5,573,902 | 11/1996 | Daubendiek et al. | 430/567 |
| 5,576,168 | 11/1996 | Daubendiek et al. | 430/567 |
| 5,576,171 | 11/1996 | Olm et al. | 430/567 |
| 5,582,965 | 12/1996 | Deaton et al. | 430/567 |
| 5,612,175 | 3/1997 | Eshelman et al. | 430/567 |
| 5,612,176 | 3/1997 | Eshelman et al. | 430/567 |
| 5,709,988 | 1/1998 | Black et al. | 430/567 |

*Primary Examiner*—Mark F. Huff
*Attorney, Agent, or Firm*—Paul A. Leipold

[57] ABSTRACT

The invention relates to an emulsion comprising tabular grains of greater than or equal to about 3.7 $\mu$m area weighted mean equivalent circular diameter and thiourea sensitizer having the structural formula:

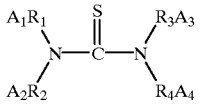

wherein each of $R_1$, $R_2$, $R_3$, and $R_4$ independently can represent an alkylene, cycloalkylene, carbocyclic arylene or heterocyclic arylene, alarylene or aralkylene group; or taken together with the nitrogen atom to which they are attached, $R_1$ and $R_2$ or $R_3$ and $R_4$ can complete a 5- to 7-member heterocyclic ring; and each of $A_1$, $A_2$, $A_3$, and $A_4$ independently is hydrogen or represents a carboxylic, sulfinic, sulfonic, hydroxamic, mercapto, sulfonamido or primary or secondary amino nucleophilic group;

with the proviso that at least one of $A_1R_1$ to $A_4R_4$ contains a nucleophilic group bonded to a urea nitrogen atom through a 2- or 3-member chain.

28 Claims, No Drawings

CHEMICAL SENSITIZATION OF LARGE TABULAR GRAIN EMULSIONS

FIELD OF THE INVENTION

This invention relates to the use of certain tetrasubstituted thiourea compounds to chemically sensitize silver halide tabular grain emulsions and photographic elements comprising such emulsions.

BACKGROUND OF THE INVENTION

There is a continuing demand for photographic films and papers that have a greater sensitivity to light while minimizing fog and graininess.

One of the principle ways of increasing the general sensitivity to light of a silver halide photographic emulsion is by the process of chemical sensitization in which a small quantity of certain types of chemical reagents are digested with the silver halide emulsion. Correspondingly, there is continuing need for new chemical reagents, known as chemical sensitizers, that will produce still higher sensitivity with silver halide emulsions. It is desired in particular to find more effective chemical sensitizers for silver halide emulsions that contain large size silver halide grains to satisfy the demand for high speed photographic films and papers.

One of the most important types of chemical sensitizers is the sulfur sensitizers. These compounds contain labile sulfur atoms that form silver sulfide on the silver halide emulsion grains during digestion. Examples of sulfur sensitizers include sodium thiosulfate and various thiourea compounds. A particular class of tetrasubstituted thiourea compounds containing a nucleophilic substituent group was disclosed in Burgmaier and Herz, U.S. Pat. No. 4,810,626. These compounds were shown to be very effective sensitizers under mild digestion conditions and were shown to produce higher speeds than many other thiourea compounds that were lacking the specified nucleophilic substituents. There was, however, no teaching that these sensitizers would produce higher speeds than the more common sulfur sensitizer, sodium thiosulfate, for silver halide emulsions in general, provided that the temperature and time duration for the thiosulfate digestion would be adjusted to the optimum. Subsequent to the disclosure by Burgmaier and Herz, these tetrasubstituted thiourea compounds with the specified nucleophilic substituents were disclosed as sensitizers for tabular grain emulsions comprising epitaxially deposited silver halide protrusions at the comers and edges of the host tabular emulsions (e.g., Daubendiek et al U.S. Pat. Nos. 5,576,168 and 5,573,902; Olm et al U.S. Pat. Nos. 5,503,970 and 5,576,171; and Deaton et al U.S. Pat. No. 5,582,965). But tabular emulsions not involving the epitaxial deposition of silver halide protrusions are generally preferred since fewer steps are required in manufacturing.

There have also been examples disclosed of non-epitaxy tabular grain emulsions that have been sensitized with the thiourea compounds of Burgmaier and Herz, but all of these examples were for tabular emulsions not greater than about 3.5 $\mu$m area weighted mean equivalent circular diameter as determined by examination of the grains by electron microscopy (see, for example, Deaton, U.S. Pat. No. 5,049,485, Example 3). There was no evidence that any higher sensitivity could be obtained with the thiourea compounds than with sodium thiosulfate.

PROBLEMS TO BE SOLVED BY THE INVENTION

There is a need for a method of providing improved sensitivity for large tabular grain silver halide emulsions.

There is a particular need for the ability to improve the sensitivity of large tabular grain bromoiodide emulsions.

SUMMARY OF THE INVENTION

An object of this invention is to overcome disadvantages of prior methods of sensitization of large tabular grain emulsions.

The invention generally comprises an emulsion comprising tabular grains of at least 3.7 $\mu$m area weighted mean equivalent circular diameter, a thiourea sensitizer having the structural formula:

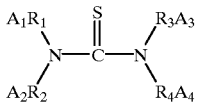

wherein each of $R_1$, $R_2$, $R_3$, and $R_4$ independently can represent an alkylene, cycloalkylene, carbocyclic arylene or heterocyclic arylene, alkarylene or aralkylene group; or taken together with the nitrogen atom to which they are attached, $R_1$ and $R_2$ or $R_3$ and $R_4$ can complete a 5- to 7-member heterocyclic ring; and each of $A_1$, $A_2$, $A_3$, and $A_4$ independently is hydrogen or represents a carboxylic, sulfinic, sulfonic, hydroxamic, mercapto, sulfonamido or primary or secondary amino nucleophilic group;

with the proviso that at least one of $A_1R_1$ to $A_4R_4$ contains a nucleophilic group bonded to a thiourea nitrogen atom through a 2- or 3-member chain.

In another embodiment the invention comprises a photographic element comprising at least one emulsion comprising tabular grains of greater than or equal to about 3.7 $\mu$m area weighted equivalent circular diameter and thiourea sensitizer having the structural formula:

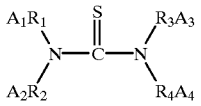

wherein each of $R_1$, $R_2$, $R_3$, and $R_4$ independently can represent an alkylene, cycloalkylene, carbocyclic arylene or heterocyclic arylene, alkarylene or aralkylene group; or taken together with the nitrogen atom to which they are attached, $R_1$ and $R_2$ or $R_3$ and $R_4$ can complete a 5- to 7-member heterocyclic ring; and each of $A_1$, $A_2$, $A_3$, and $A_4$ independently is hydrogen or represents a carboxylic, sulfinic, sulfonic, hydroxamic, mercapto, sulfonamido or primary or secondary amino nucleophilic group;

with the proviso that at least one of $A_1R_1$ to $A_4R_4$ contains a nucleophilic group bonded to a thiourea nitrogen atom through a 2- or 3-member chain.

ADVANTAGEOUS EFFECT OF THE INVENTION

The invention provides improved sensitivity for large tabular grain emulsions. It further provides emulsions that are stable and uniformly sensitive.

DETAILED DESCRIPTION OF THE INVENTION

The emulsions of the invention have numerous advantages over prior emulsions and photographic elements. The emulsions of the invention provide a stable, highly sensitive tabular grain emulsion, wherein the tabular grains comprise grains with a {111} major face. The sensitization may be carried out reliably to produce uniformly sensitive grains. The sensitization of the invention is less variable and produces a uniform sensitivity of the tabular grains even when there are slight variations in the time and temperature at which sensitization is carried out. The sensitizations of the emulsions of the invention further are less variable as a result of slight variations in the amount of sensitizing dyes available during spectral sensitization. The emulsions of the invention provide low fog in photographic elements formed with the emulsions. Further, the emulsions after imaging of photographic elements provide an image with less graininess. Photographic elements utilizing these emulsions also have improved contrast and gradation.

Despite there being no evidence that higher sensitivity could be obtained for non-epitaxy tabular grain emulsions by sensitizing with the tetrasubstituted thiourea compounds of Burgmaier and Herz U.S. Pat. No. 4,810,626, the present inventors diligently continued to examine the properties of the aforementioned thiourea sensitizers. We have now discovered that, relative to sensitizations under optimal conditions with sodium thiosulfate, these thiourea compounds provide speed advantages with lower fog and lower graininess for non-epitaxy tabular grain emulsions having greater than or equal to about 3.7 $\mu$m area weighted mean equivalent circular diameter (ECD) as determined by electron microscopy. Grain sizes referred to in this application are determined by electron microscopy, either transmission or scanning electron microscopy. This is a surprising result since we had previously found, and will demonstrate here abundantly again, that sensitizations of non-epitaxy tabular emulsions employing sodium thiosulfate provided the same sensitivity as the thiourea sensitizations when the ECD of the tabular emulsion was less than about 3.7 $\mu$m and provided that the digestion conditions for each sensitizer type were independently optimized.

The present invention provides a silver halide photographic material which comprises a sensitizing amount of a tetrasubstituted thiourea compound having the structural formula:

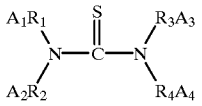

wherein each of $R_1$, $R_2$, $R_3$, and $R_4$ independently can represent an alkylene, cycloalkylene, carbocyclic arylene, heterocyclic arylene, alkarylene or aralkylene group; or taken together with the nitrogen atom to which they are attached, $R_1$ and $R_2$ or $R_3$ and $R_4$ can complete a 5- to 7-member heterocyclic ring; and each of $A_1$, $A_2$, $A_3$, and $A_4$ independently is hydrogen or represents a carboxylic, sulfinic, sulfonic, hydroxamic, mercapto, sulfonamido or primary or secondary amino nucleophilic group;

with the proviso that at least one of $A_1R_1$ to $A_4R_4$ contains the nucleophilic group bonded to a thiourea nitrogen atom through a 2- or 3-member chain.

The term "nucleophilic" group, as employed in this invention, refers to an atom such as an oxygen atom of oxygen acids, a sulfur atom of sulfur acids and a nitrogen atom of nitrogen acids or of a primary or secondary amine. Such nucleophilic groups comprise carboxylic (—COOH), sulfinic (—$SO_2H$), sulfonic (—$SO_3H$), hydroxamic (—NHOH), mercaptan (—SH), sulfonamido (—$SO_2NH$—) and primary and secondary amines.

Inorganic or organic salts of these acids are equally useful.

Preferably, at least one of $R_1A_1$ to $R_4A_4$ is an omega-bound methyl or ethyl carboxylic acid or a salt thereof.

Other than a nucleophilic group as defined above, which is necessary for successful chemical sensitization of silver halide and which is attached to the thiourea nitrogen through a two- or three-member chain, the composition of the remaining RA groups on the 1,1,3,3-tetrasubstituted thiourea compound can vary widely for achieving the desired chemical sensitization of silver halides.

Alkylene groups, which can be represented by at least one of $R_1$ to $R_4$ which is not bonded to the required nucleophilic group, can contain from 1 to 6 carbon atoms, preferably from 1 to about 4 carbon atoms for greater solubility properties.

When the $R_1$ to $R_4$ groups are cycloalkylene, the ring portion can contain from about 3 to about 8, preferably about 5 or 6 carbon atoms. Where a cycloalkylene group has the required nucleophilic group bonded thereto, it is important for successful operation of this invention that such group be bonded to one of the thiourea nitrogen atoms through a 2- or 3-member chain.

Where one of the $R_1$ to $R_4$ groups is an aromatic heterocyclic or an aromatic carbocyclic ring, such ring system can comprise from about 5 to about 10 atoms in the ring, such as, for example, pyrrole, phenyl, naphthyl, pyridinyl, quinolyl, and naphthryl. When the aromatic heterocyclic or aromatic carbocyclic group has bonded thereto the required nucleophilic group, the chain separating the nucleophilic group from a thiourea nitrogen atom comprises from 2 to 3 members.

Where an $R_1$ to $R_4$ group is an alkarylene or aralkylene, the alkylene moiety thereof can comprise from about 1 to about 3 carbon atoms and the aryl portion is an aromatic group as described above. When the required nucleophilic group is bonded to an aralkylene group, the chain separating the nucleophilic group from a thiourea nitrogen atom comprises from 2 to 3 atoms.

Heterocyclic rings which can be formed by a thiourea nitrogen atom with $R_1$ and $R_2$ or with $R_3$ and $R_4$ can comprise 5- or 6-ring members. Typical heterocyclic rings so formed include pyridine, morpholine, piperdine, and diazine.

Specific 1,1,3,3-tetrasubstituted-2-thiourea compounds useful in this invention include the following:

1

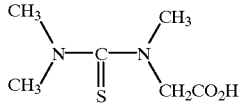

2

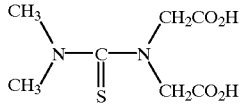

3

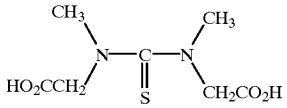

-continued

4

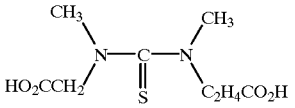

5

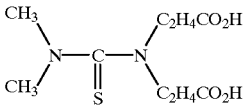

6

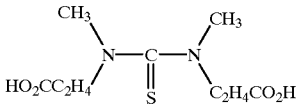

7

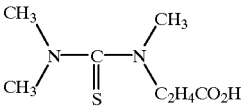

8

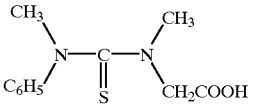

9

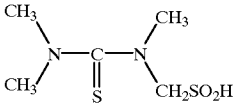

10

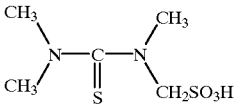

11

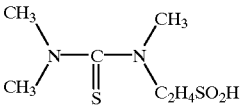

12

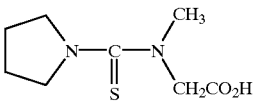

13

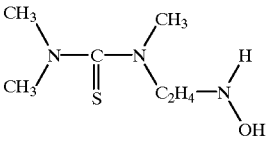

14

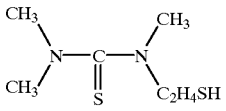

15

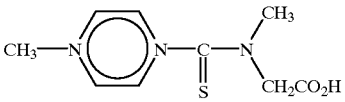

-continued

16

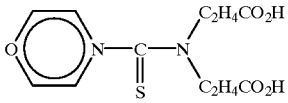

17

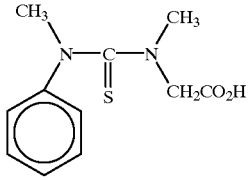

18

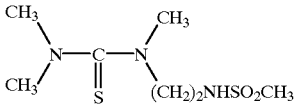

19

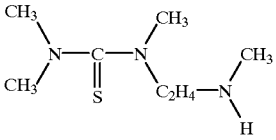

20

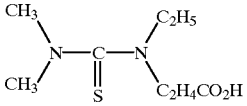

21

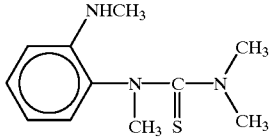

Synthesis of the thiourea compounds of the invention may be performed by techniques known in the art. Representative techniques are disclosed in U.S. Pat. No. 4,810,626—Burgmaier et al.

Gold sensitizers are commonly used in combination with sulfur sensitizers. Any suitable gold chemical sensitizing material may be utilized in the invention. They may be gold(I) or gold(III) compounds. Gold(I) compounds are preferred because they avoid disadvantageous redox properties of the gold(II) compounds. The gold compounds may be soluble or insoluble. Soluble compounds are preferred for ease of dispersal into the emulsions. One such soluble gold(I) compound is trisodium dithiosulfato gold(I), which also imparts two molar equivalents of sulfur sensitization by the thiosulfate ions that are contained in the gold(I) complex ion. While this compound may be used in the present invention, it is preferred to use other gold(I) compounds that do not contain any labile sulfur in order that the thiourea compounds of this invention may be used to the fullest extent to supply all of the sulfur sensitization. Examples of suitable soluble gold(I) compounds that do not contain labile sulfur are found in Deaton U.S. Pat. Nos. 5,049,484 and 5,252,455, and references therein. Preferred gold(I) compounds are disclosed in Deaton U.S. Pat. No. 5,049,485. The preferred compounds comprise a soluble gold(I) compound of the formula:

$$AuL_2^+X^- \text{ or } AuL(L^1)^+X^-$$

wherein

L is a mesoionic compound;

X is an anion; and $L^1$ is a Lewis donor ligand.

The above compounds are preferred because they have good stability and solubility in water. A most preferred compound is

A1

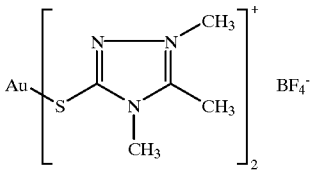

The amount of gold sensitizer utilized may be any suitable amount. A suitable amount is between 0.0001 and 0.1 mmol/mol silver. A more preferred amount is between 0.0005 and 0.020 mmol/mol silver. It is most preferred that the level be between 0.001 and 0.01 mmol/mol silver, as this range usually gives optimum sensitivity.

The tetrasubstituted thiourea compounds may be combined in the present invention with other types of chemical sensitizers in addition to, or in place of, the aforementioned gold sensitizers. These chemical sensitizers included other noble metal compounds, selenium or tellurium compounds, various ammonium or alkaline earth salts of thiocyanate, and reduction sensitizing compounds. These chemcial sensitizers and are described in *Research Disclosure,* Vol. 365 (1994) Item 36544, IV. Chemical sensitization.

In addition to being chemcially sensitized, emulsions are frequently also sensitized with organic dyes to control the spectral sensitivity of the emulsions in the visible and infrared parts of the spectrum as desired for particular applications. Suitable spectral sensitizing dyes are described in *Research Disclosure,* Vol. 365 (1994) Item 36544, V. Spectral sensitization and desensitization.

In addition to being chemically and spectrally sensitized, emulsions are generally also treated with antifoggants and stabilizers to provide low fog with high sensitivity and stability under demanding storage conditions as described in *Research Disclosure,* Vol. 365 (1994) Item 36544, VII. Antifoggants and stabilizers.

Any suitable tabular mean silver halide emulsion of the invention size may be utilized in the invention. Typical of such tabular grain emulsions and techniques for grain formation are those described in Corben U.S. Pat. No. 4,210,450;
Wilgus et al U.S. Pat. No. 4,434,226;
Kofron et al U.S. Pat. No. 4,439,520;
Daubendiek et al U.S. Pat. No. 4,414,310;
Solberg et al U.S. Pat. No. 4,433,048;
Maskasky U.S. Pat. No. 4,435,501
Kofron et al U.S. Pat. No. 4,439,520
Yamada et al U.S. Pat. No. 4,672,027;
Sugimoto et al U.S. Pat. No. 4,665,012;
Yamada et al U.S. Pat. No. 4,679,745;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Antoniades et al U.S. Pat. No. 5,250,403
Sutton et al U.S. Pat. No. 5,300,413;
Delton U.S. Pat. No. 5,310,644;
Chang et al U.S. Pat. No. 5,314,793;
Brust et al U.S. Pat. No. 5,314,798;
Black et al U.S. Pat. No. 5,334,495;
Chaffee et al U.S. Pat. No. 5,358,840;
Delton U.S. Pat. No. 5,372,927. and
Fenton et al U.S. Pat. No. 5,476,760;

The mean equivalent circular diameter (ECD) of the grains of the invention is greater than or equal to about 3.7 μm area weighted. The ECD preferably is between 3.7 and about 10 μm for best photographic performance and lower graininess. The ECD area weighted mean of the grains is determined by examination of electron micrographs of the grains. The micrographs are obtained by either by transmission or scanning electron microscopy.

Preferred tabular grains are the silver bromoiodide grains. It is preferred that the iodide content be 0 to 10 mol percent and most preferred that the iodide content be 0 to 6 mol percent. The ratio of diameter to thickness generally is greater than about 8 to 1. It is preferred that the ratio of diameter and thickness be between about 20 to 1 and 100 to 1 for the large diameter grains of the invention.

Further description of tabular grain emulsions and their preparation and modification can be found in *Research Disclosure,* Vol. 365 (1994) Item 36544, Section I. Emulsion grains and their preparation. Dopants for the tabular grains that may be utilized in the invention include those disclosed in February 1995 *Research Disclosure* Item 37038, Section XV (B).

Subsequent to their preparation the emulsions can be prepared for photographic use as described by *Research Disclosure,* Item 36544, cited above: I. Emulsion grains and their preparation, E. Blends, layers and performance categories; II. Vehicles, vehicle extenders, vehicle like addenda and vehicle related addenda; III. Emulsion washing. The emulsions or the photographic elements in which they are incorporated can additionally include one or more of the following features illustrated by *Research Disclosure, Item* 36544, cited above: VI. UV dyes, optical brighteners, luminescent dyes; VII. Antifoggants and stabilizers; VIII. Absorbing and scattering materials; IX. Coating physical property modifying addenda; X. Dye image formers and modifiers; XI. Layers and layers arrangement; XII. Features applicable only to color negative; XIII. Features applicable only to color positive; XIV. Scan facilitating features; and XV. Supports.

The exposure and processing of photographic elements incorporating the emulsion of the invention can take any conventional form, illustrated by *Research Disclosure, Item* 36544, cited above. XVI. Exposure; XVIII Chemical development system; XIX. Development; and XX. Desilvering, washing, rinsing and stabilizing.

The following examples illustrate the practice of this invention. They are not intended to be exhaustive of all possible variations of the invention. Parts and percentages are by weight unless otherwise indicated.

EXAMPLES

The following emulsion examples A–G were optimally sulfur and gold sensitized with conventional sulfur and gold sources, such as sodium thiosulfate and trisodium dithiosulfato gold(I), and also with the thiourea compound 1 of this invention and the gold(I) compound A1 disclosed in U.S. Pat. No. 5,049,485 (Deaton). In all cases, they were spectrally sensitized with a combination of SD1 and SD2 as green sensitizer dyes present during the sensitization; or with a combination of SD3and SD4 as red sensitizer dyes present during the sensitization. The structural formulas of SD1, SD2, SD3, and SD4 are given in the Appendix. Single layer coating on a transparent film support employed the following formats: Magenta format 1: silver coverage of 1.08 g/m$^2$, magenta dye forming couplers coverage of 0.11 g/m$^2$ of MC1, 0.03 g/m$^2$ of MC2 and 0.03 g/m$^2$ of MC3. Magenta format 2: silver coverage of 0.86 g/m$^2$, magenta dye forming couplers coverage of 0.22 g/m$^2$ of MC2, 0.12 g/m$^2$ of MC3, and 0.22 g/m$^2$ of MC4. The cyan format used silver coverage of 0.81 g/m$^2$ and a cyan dye forming coupler CC at coverage of 1.61 g/m$^2$. The structural formulas of MC1, MC2, MC3, MC4, and CC are given in the Appendix.

Samples of the coatings were exposed by a daylight balanced tungsten light source through a graduated density test object and a Wratten 9 filter (wavelength>480 nm transmitted) for magenta records and a Wratten 23A filter (wavelength>560 nm transmitted) for cyan records. Processing was conducted using the Kodak Flexicolor™ C41 color negative processing chemicals and procedures. The sensitometric speed comparisons are made with the minimum density (fog) and the relative speed at an optical density of 0.15 above the minimum density. Each speed unit difference is equal to 0.01 logE, where E represents the light exposure in lux-seconds unit.

Granularity readings on the same processed strips were made according to procedures described in the *SPSE Handbook of Photographic Science and Engineering,* edited by W. Thomas, pp. 934–939. Granularity readings at each step were divided by the contrast at the same step, and the minimum contrast normalized granularity reading was recorded. Contrast normalized granularity is reported in grain units (g.u.), in which each g.u. represents a 5% change. A positive change corresponds to a grainier image, and negative changes are desirable. Since the random dot model for granularity predicts that granularity is inversely proportional to the square root of the number of imaging centers (M. A. Kriss in *The Theory of the Photographic Process,* 4th Ed. T. H. James, ed. New York, Macmillan, 1977; p.625), and larger grains generally are needed to achieve higher speeds, it is generally accepted that for tabular emulsions, granularity will increase at a rate of ca. 7 g.u. for each gain of 30 log speed units at constant silver coverage and photoefficiency.

Emulsion A:

A 4.8×0.10 μm silver bromoiodide (overall iodide content 2%) tabular grain emulsion was prepared by the following method:

To a 4.6 liter aqueous solution containing 0.4 weight % bone gelatin and 7 g/L sodium bromide at 75° C. with vigorous stirring in the reaction vessel was added by single jet addition of 0.21M silver nitrate solution at constant flow rate over a 15 minute period, consuming 1.1% of total silver. Subsequently, 4.95 g of ammonium sulfate was added to the vessel, followed by the addition of 100 mL sodium hydroxide at 0.8M. After 1.5 min, 100 mL nitric acid at 0.8M was added. Then 3 liter of aqueous solution containing 7.4% gelatin by weight and 0.09M sodium bromide at 75° C. was added to the reaction vessel and held for 5 minutes. Then double jet addition of an aqueous 3.0M silver nitrate solution and an aqueous solution of 3.0M sodium bromide were added simultaneously to the reaction vessel utilizing accelerated flow rate (7.3× from start to finish) over 43 minutes while controlling pBr at 1.3, consuming 80 mole % of total silver. At 40 minute into this segment, a 70 mL of aqueous solution of potassium hexacyanoruthenate at 0.35% by weight was added to the reaction vessel. Both silver and salt solutions were halted after the accelerated flow segment while the pBr of the vessel was adjusted to 1.2 by addition of sodium bromide salt. Then 5 mL of an aqueous solution of potassium selenocyanate at 0.017% by weight was added to the reaction vessel. Silver iodide Lippmann seed at 2 mole % of total silver was then added to the reaction vessel. After a two-minute period halt, the 3.0M silver nitrate solution was used to adjust the pBr from 1.1 to 2.3. Then the 3.0M sodium bromide solution was added simultaneously with the silver nitrate solution to the reaction vessel to control pBr at 2.3 until a total of 12.1 mole silver was prepared. The emulsion was cooled to 40° C. and washed by ultrafiltration method.

Example A1M

Each mole of Emulsion A was optimally sensitized with 0.8 mmole of SD1 and 0.2 mmole of SD2 green sensitizing dyes, and with 1.4 mg of sodium thiosulfate and 2.8 mg of trisodium dithiosulfato gold(I).

Example A2M

Each mole of Emulsion A was optimally finished with 0.8 mmole of SD1 and 0.2 mmole of SD2 green sensitizing dyes, and with 2.7 mg of thiourea sensitizer compound 1 and 2.6 mg of gold(I) sensitizer compound A1.

Examples A1M and A2M were coated in magenta format 1. The sensitometric comparison of the conventional Emulsion A1M and the invention A2M is provided in Table 1.

TABLE 1

Speed, Fog, and Contrast Normalized Granularity Response for Emulsion A

| Example | Fog | Δ Speed | Rel. Gran. |
|---|---|---|---|
| A1M | 0.18 | check | check |
| A2M | 0.14 | +5 | −1.9 |

Thus the invention Emulsion A2M provided less fog, higher speed, and less graininess than the conventional Emulsion A1M.

Emulsion B:

A 4.3×0.11 μm silver bromoiodide (overall iodide content 3.8%) tabular grain emulsion was prepared by the following method.

To a 4.6 liter aqueous solution containing 0.4 weight % bone gelatin and 7 g/L sodium bromide at 75° C. with vigorous stirring in the reaction vessel was added by single jet addition of 0.21M silver nitrate solution at constant flow rate over a 15-minute period, consuming 1.1% of total silver. Subsequently, 4.95 g of ammonium sulfate was added to the vessel, followed by the addition of 100 ml sodium hydroxide at 0.8M. After 1.5 min, 100 mL nitric acid at 0.8M was added. Then 3 liter of aqueous solution containing 7.4% gelatin by weight and 0.09M sodium bromide at 75° C. was added to the reaction vessel and held for 5 minutes. Then double jet addition of an aqueous 3.0M silver nitrate solution and an aqueous solution of 2.97M sodium bromide and 0.03M potassium iodide were added simultaneously to the reaction vessel utilizing accelerated flow rate (7.3× from start to finish) over 41 minutes while controlling pBr at 1.3, consuming 70 mole % of total silver. At 40 minutes into this segment, a 70 mL of aqueous solution of potassium hexacyanoruthenate at 0.35% by weight was added to the reaction vessel. Both silver and salt solutions were halted after the accelerated flow segment while the pBr of the vessel was adjusted to 1.0 by addition of sodium bromide salt. Then 5 mL of an aqueous solution of potassium selenocyanate at 0.017% by weight was added to the reaction vessel. Silver iodide Lippmann seed at 3% of total silver was then added to the reaction vessel. After a two-minute period halt, the 3.0M silver nitrate solution was used to adjust the pBr from 1.0 to 2.3. Then a 3.0M sodium bromide solution was added simultaneously with the silver nitrate solution to the reaction vessel to control pBr at 2.3 until a total of 12.1 mole silver was prepared. The emulsion was cooled to 40° C. and washed by ultrafiltration method.

Example B1C

Each mole of Emulsion B was optimally sensitized with 0.18 mmole of SD3 and 0.72 mmole of SD4 red sensitizing dyes, and with 1.0 mg of sodium thiosulfate and 2.0 mg of trisodium dithiosulfato gold(I).

Example B2C

Each mole of Emulsion B was optimally sensitized with 0.2 mmole of SD3 and 0.8 mmole of SD4 red sensitizing dyes, and with 2.1 mg of thiourea sensitizer compound 1 and 2.0 mg of gold(I) sensitizer compound A1.

Example B1M

Each mole of Emulsion B was optimally sensitized with 0.8 mmole of SD1 and 0.2 mmole of SD2 green sensitizing dyes, and with 1.2 mg of sodium thiosulfate and 2.4 mg of trisodium dithiosulfato gold(I).

Example B2M

Each mole of Emulsion B was optimally sensitized with 0.8 mmole of SD1 and 0.2 mmole of SD2 green sensitizing dyes, and with 2.6 mg of thiourea sensitizer compound 1 and 2.5 mg of gold(I) sensitizer compound A1.

Examples B1C and B2C were coated in the cyan format, and Examples B1M and B2M were coated in magenta format 1. The sensitometric comparisons of conventional emulsions B1C and B1M and invention emulsions B2C and B2M are provided in Table 2.

TABLE 2

Speed, Fog, and Contrast Normalized Granularity Response for Emulsion B

| Example | Fog | Δ Speed | Rel. Gran. |
|---|---|---|---|
| B1C | 0.10 | check | check |
| B2C | 0.07 | +3 | −2.5 |
| B1M | 0.16 | check | check |
| B2M | 0.12 | +3 | −1.6 |

Thus, the invention Emulsions B2C and B2M provided less fog, higher speed, and less graininess relative to conventional Emulsions B1C and B1M, respectively.

Emulsion C:

A 3.7×0.14 μm silver bromoiodide (overall iodide content 3.8%) tabular grain emulsion was prepared by the following method:

To a 4.6 liter aqueous solution containing 0.4 weight % bone gelatin and 7 g/L sodium bromide at 70° C. with vigorous stirring in the reaction vessel was added by single jet addition of 0.21M silver nitrate solution at constant flow rate over a 15-minute period, consuming 1.1% of total silver. Subsequently, 24.8 g of ammonium sulfate was added to the vessel, followed by the addition of 152 mL sodium hydroxide at 2.5M. After 5 min, 152 mL nitric acid at 2.5M was added. Then 3 liter of aqueous solution containing 7.4% gelatin by weight and 0.03M sodium bromide at 70° C. was added to the reaction vessel and held for 5 minutes. Then double jet addition of an aqueous 3.0M silver nitrate solution and an aqueous solution of 2.97M sodium bromide and 0.03M potassium iodide were added simultaneously to the reaction vessel utilizing accelerated flow rate (7.3× from start to finish) over 46 minutes while controlling pBr at 1.6, consuming 70 mole % of total silver. At 40 minutes into this segment, a 70 mL of aqueous solution of potassium hexacyanoruthenate at 0.35% by weight was added to the reaction vessel. Both silver and salt solutions were halted after the accelerated flow segment while the pBr of the vessel was adjusted to 1.0 by addition of sodium bromide salt. Then 5 mL of an aqueous solution of potassium selenocyanate at 0.017% by weight was added to the reaction vessel. Silver iodide Lippmann seed at 3.1% of total silver was then added to the reaction vessel. After a two-minute period halt, the 3.0 silver nitrate solution was used to adjust the pBr from 1.0 to 2.3. Then a 3.0M sodium bromide solution was added simultaneously with the silver nitrate solution to the reaction vessel to control pBr at 2.3 until a total of 12.1 mole silver was prepared. The emulsion was cooled to 40° C. and washed by ultrafiltration method.

Example C1C:

Each mole of Emulsion C was optimally sensitized with 0.16 mmole of SD3 and 0.62 mmole of SD4 red sensitizing dyes, and with 1.0 mg of sodium thiosulfate and 2.0 mg of disodium trithiosulfato gold(I).

Example C2C

Each mole of Emulsion C was optimally sensitized with 0.16 mmole of SD3 and 0.65 mmole of SD4 red sensitizing dyes, and with 1.4 mg of thiourea sensitizer compound 1 and 1.4 mg of gold(I) sensitizer compound A1.

Example C1M

Each mole of Emulsion C was optimally sensitized with 0.57 mmole of SD1 and 0.14 mmole of SD2 green sensitizing dyes, and with 0.9 mg of sodium thiosulfate and 1.9 mg of disodium trithiosulfato gold(I).

Example C2M

Each mole of Emulsion C was optimally sensitized with 0.6 mmole of SD1 and 0.15 mmole of SD2 green sensitizing dyes, and with 1.7 mg of thiourea sensitizer compound 1 and 1.6 mg of gold(I) sensitizer compound A1.

Examples C1C and C2C were coated in the cyan format, and Examples B1M and B2M were coated in magenta format 1. The sensitometric comparisons of the conventional emulsions C1C and C1M to the invention emulsions C2C and C2M are provided in Table 3.

TABLE 3

Speed, Fog, and Contrast Normalized Granularity Response for Emulsion C

| Example | Fog | Δ Speed | Rel. Gran. |
|---|---|---|---|
| C1C | 0.09 | check | check |
| C2C | 0.07 | +4 | −2.3 |
| C1M | 0.16 | check | check |
| C2M | 0.14 | +7 | +1.0 |

Thus, the invention Emulsion C2C provided less fog and higher speed and less graininess than comparison Emulsion C1C. Relative to comparison Emulsion C1M, the invention Emulsion C2M provided a slight increase in graininess but a much higher increase in speed, thus providing a net gain in sensitivity.

Emulsion D:

A 3.2×0.13 μm silver bromoiodide (overall iodide content 3.8%) tabular grain emulsion was prepared by the following method:

To a 4.6 liter aqueous solution containing 0.4 weight % bone gelatin and 7 g/L sodium bromide at 66° C. with vigorous stirring in the reaction vessel was added by single jet addition of 0.21M silver nitrate solution at constant flow rate over a 15-minute period, consuming 1.1% of total silver. Subsequently, 19.8 g of ammonium sulfate was added to the vessel, followed by the addition of 122 mL sodium hydroxide at 2.5M. After 5 min, 122 mL nitric acid at 2.5M was added. Then 3 liter of aqueous solution containing 7.4% gelatin by weight and 0.025 sodium bromide at 66° C. was added to the reaction vessel and held for 5 minutes. Then double jet addition of an aqueous 3.0M silver nitrate solution and an aqueous solution of 2.97M sodium bromide and 0.03M potassium iodide were added simultaneously to the reaction vessel utilizing accelerated flow rate (7.3× from start to finish) over 46 minutes while controlling pBr at 1.6, consuming 74 mole % of total silver. At 40 minutes into this segment, a 70 mL of aqueous solution of potassium hexacyanoruthenate at 0.35% by weight was added to the reaction vessel. Both silver and salt solutions were halted after the accelerated flow segment while the pBr of the vessel was adjusted to 1.1 by addition of sodium bromide salt. Then 5 mL of an aqueous solution of potassium-selenocyanate at 0.017% by weight was added to the reaction vessel. Silver iodide Lippmann seed at 3.1% of total silver was then added to the reaction vessel. After a two-minute period halt, the 3.0M silver nitrate solution was used to adjust the pBr from 1.1 to 2.3. Then a 3.0M sodium bromide solution was added simultaneously with the silver nitrate solution to the reaction vessel to control pBr at 2.3 until a total of 12.1 mole silver was prepared. The emulsion was cooled to 40° C. and washed by ultrafiltration method.

Example D1M

Each mole of Emulsion D was optimally sensitized with 0.69 mmole of SD1 and 0.17 mmole of SD2 green sensitizing dyes, and with 1.1 mg of sodium thiosulfate and 2.3 mg of trisodium dithiosulfato gold(I).

Example D2M

Each mole of Emulsion D was optimally sensitized with 0.67 mmole of SD1 and 0.17 mmole of SD2 green sensitizing dyes, and with 1.9 mg of thiourea sensitizer compound 1 and 1.8 mg of gold(I) sensitizer compound A1.

Example emulsions D1M and D2M were coated in magenta format 1. The sensitometric comparison of Emulsion D1M and Emulsion D2M is given in Table 4.

TABLE 4

Speed, Fog, and Contrast Normalized Granularity Response for Emulsion D

| Example | Fog | Δ Speed | Rel. Gran. |
|---|---|---|---|
| D1M | 0.12 | check | check |
| D2M | 0.07 | +2 | +0.8 |

Thus, the Emulsion D2M provided only a marginal speed advantage that was accompanied by higher graininess, thus providing no net sensitivity increase relative to Emulsion D1M. This comparison shows that no sensitivity increase was obtained by using a tetrasubstituted thiourea sensitizer such as Compound 1 for tabular grain emulsions having less than about 3.7 μm area weighted mean ECD.

Emulsion E:

A 2.6×0.13 μm silver bromoiodide (overall iodide content 3.8%) tabular grain emulsion was prepared by the following method:

To a 4.6 liter aqueous solution containing 0.4 weight % bone gelatin and 7 g/L sodium bromide at 60° C. with vigorous stirring in the reaction vessel was added by single jet addition of 0.21M silver nitrate solution at constant flow rate over a 15-minute period, consuming 1.1% of total silver. Subsequently, 19.8 g of ammonium sulfate was added to the vessel, followed by the addition of 122 mL sodium hydroxide at 2.5M. After 5 min, 122 mL nitric acid at 2.5M was added. Then 3 liter of aqueous solution containing 7.4% gelatin by weight at 60° C. was added to the reaction vessel and held for 5 minutes. Then double jet addition of an aqueous 3.0M silver nitrate solution and an aqueous solution of 2.97M sodium bromide and 0.03M potassium iodide were added simultaneously to the reaction vessel utilizing accelerated flow rate (7.3× from start to finish) over 46 minutes while controlling pBr at 1.7, consuming 74 mole % of total silver. At 40 minute into this segment, a 70 mL of aqueous solution of potassium hexacyanoruthenate at 0.35% by weight was then added to the reaction vessel. Both silver and salt solutions were halted after the accelerated flow segment while the pBr of the vessel was adjusted to 1.2 by addtion of sodium bromide salt. Then 5 mL of an aqueous solution of potassium selenocyanate at 0.017% by weight was added to the reaction vessel. Silver iodide Lippmann seed at 3.1% of total silver was then added to the reaction vessel. After a two-minute period halt, the 3.0M silver nitrate solution was used to adjust the pBr from 1.2 to 2.5. Then a 3.0M sodium bromide solution was added simultaneously with the silver nitrate solution to the reaction vessel to control pBr at 2.5 until a total of 12.1 mole silver was prepared. The emulsion was cooled to 40° C. and washed by ultrafiltration method.

Example E1M

Each mole of Emulsion E was optimally sensitized with 0.67 mmole SD1 and 0.17 mmole SD2 green sensitizing dyes, and with 1.1 mg of sodium thiosulfate and 2.3 mg of trisodium dithiosulfato gold(I).

Example E2M

Each mole of Emulsion E was optimally sensitized with 0.70 mmole SD1 and 0.17 mmole SD2 green sensitizing dyes, and with 1.9 mg of Compound 1 and 1.9 mg of gold sensitizer A1.

Example emulsions E1M and E2M were coated in magenta format 1. The sensitometric comparison of emulsion E2M to emulsion E1M is given in Table 5

TABLE 5

Speed, Fog, and Contrast Normalized Granularity Response for Emulsion E

| Example | Fog | Δ Speed | Rel. Grain |
|---|---|---|---|
| E1M | 0.16 | check | check |
| E2M | 0.12 | +1 | +1.0 |

Thus, the Emulsion E2M provided less fog, equal speed, but higher graininess, thus providing no net sensitivity increase relative to Emulsion E1M. This comparison shows again that no sensitivity increase was obtained by using a tetrasubstituted thiourea sensitizer such as Compound 1 for tabular grain emulsions having area weighted mean ECD less than about 3.7 μm.

Emulsion F:

A 2.1×0.10 μm silver bromoiodide (overall iodide content 3.8%) tabular grain emulsion was prepared by the following method:

To a 4.6 liter aqueous solution containing 0.4 weight % bone gelatin and 7 g/L sodium bromide at 56° C. with vigorous stirring in the reaction vessel was added by single jet addition of 0.21M silver nitrate solution at constant flow rate over a 15-minute period, consuming 1.1% of total silver. Subsequently, 19.8 g of ammonium sulfate was added to the vessel, followed by the addition of 100 mL sodium hydroxide at 2.3M. After 1.5 min, 100 mL nitric acid at 2.3M was added. Then 3 liter of aqueous solution containing 7.4% gelatin by weight and 0.066M sodium bromide at 56° C. was added to the reaction vessel and held for 5 minutes. Then double jet addition of an aqueous 3.0M silver nitrate solution and an aqueous solution of 2.97M sodium bromide and 0.03M potassium iodide were added simultaneously to the reaction vessel utilizing accelerated flow rate (7.3× from start to finish) over 46 minutes while controlling pBr at 1.5, consuming 74 mole % of total silver. At 40 minute into this segment, a 70 mL of aqueous solution of potassium hexacyanoruthenate at 0.35% by weight was then added to the reaction vessel. Both silver and salt solutions were halted after the accelerated flow segment while the pBr of the vessel was adjusted to 1.1 by addtion of sodium bromide salt. Then 130 mL of an aqueous solution of potassium selenocyanate at 0.017% by weight was added to the reaction vessel. Silver iodide Lippmann seed at 3.1% of total silver was then added to the reaction vessel. After a two-minute period halt, the 3.0M silver nitrate solution was used to adjust the pBr from 1.1 to 2.5. Then a 3.0M sodium bromide solution was added simultaneously with the silver nitrate solution E to the reaction vessel to control pBr at 2.5until a total of 12.1 mole silver was prepared. The emulsion was cooled to 40° C. and washed by ultrafitration method.

Example F1C

Each mole of Emulsion F was optimally sensitized with 0.24 mmole of SD3 and 0.96 mmole of SD4 red sensitizing dyes, and with 1.6 mg of sodium thiosulfate and 3.2 mg of trisodium dithiosulfato gold(I).

Example F2C

Each mole of Emulsion F was optimally sensitized with 0.22 mmole of SD3 and 0.88 mmole of SD4 red sensitizing dyes, and with 2.1 mg of Compound 1 and 2.1 mg of gold sensitizer A1.

Example F1M

Each mole of Emulsion F was optimally sensitized with 0.88 mmole of SD1 and 0.22 mmole of SD2 green sensitizing dyes, and with 1.2 mg of sodium thiosulfate and 2.4 mg of trisodium dithiosulfato gold(I).

Example F2M

Each mole of Emulsion F was optimally sensitized with 0.88 mmole of SD1 and 0.22 mmole of SD2 green sensitizing dyes, and with 2.4 mg of Compound 1 and 2.3 mg of gold sensitizer A1.

Example Emulsions F1C and F2C were coated in the cyan format, and example Emulsions F1M and F2M were coated in magenta format 2. The sensitometric comparisons of Emulsions F1C to F2C and of Emulsions F1M to F2M are provided in Table 6.

TABLE 6

Speed, Fog, and Contrast Normalized Granularity Response for Emulsion F

| Example | Fog | Δ Speed | Rel. Gran. |
|---|---|---|---|
| F1C | 0.08 | check | check |
| F2C | 0.08 | −4 | 0 |
| F1M | 0.15 | check | check |
| F2M | 0.12 | 0 | 0 |

The comparisons of Emulsions F1C to F2C and of Emulsions F1M to F2M demonstrate again that no sensitivity increase was obtained by using a tetrasubstituted thiourea such as Compound 1 to sensitize tabular grain emulsions having area weighted mean ECD less than about 3.7 μm.

Emulsion G:

A 2.0×0.10 lm silver bromoiodide (overall iodide content 2%) tabular grain emulsion was prepared by the following method:

To a 4.6 liter aqueous solution containing 0.4 weight % bone gelatin and 7 g/L sodium bromide at 50° C. with vigorous stirring in the reaction vessel was added by single jet addition of 0.21M silver nitrate solution at constant flow rate over a 15-minute period, consuming 1.1% of total silver. Subsequently, 14.85 g of ammonium sulfate was added to the vessel, followed by the addition of 100 mL sodium hydroxide at 2.3M. After 5 min, 100 mL nitric acid at 2.3M was added. Then 3 liter of aqueous solution containing 7.4% gelatin by weight at 50° C. was added to the reaction vessel and held for 5 minutes. Then double jet addition of an aqueous 3.0M silver nitrate solution and an aqueous solution of 3.0M sodium bromide were added simultaneously to the reaction vessel utilizing accelerated flow rate (7.3× from start to finish) over 44 minutes while controlling pBr at 1.8, consuming 80 mole % of total silver. At 40 minute into this segment, a 70 mL of aqueous solution of potassium hexacyanoruthenate at 0.35% by weight was then added to the reaction vessel. Both silver and salt solutions were halted after the accelerated flow segment while the pBr of the vessel was adjusted to 1.3 by addtion of sodium bromide salt. Then 5 mL of an aqueous solution of potassium selenocyanate at 0.017% by weight was added to the reaction vessel. Silver iodide Lippmann seed at 2 mole % of total silver was then added to the reaction vessel. After a two-minute period halt, the 3.0M silver nitrate solution was used to adjust the pBr from 1.3 to 2.6. Then the 3.0M sodium bromide solution was added simultaneously with the silver nitrate solution to the reaction vessel to control pBr at 2.6 until a total of 12.6 mole silver was prepared. The emulsion was cooled to 40° C. and washed by ultrafiltration method.

Example G1M

Each mole of Emulsion G was optimally sensitized with 0.90 mmole of SD1 and 0.23 mmole of SD2 green sensitizing dyes, and with 1.5 mg of sodium thiosulfate and 3.0 mg of trisodium dithiosulfato gold(I).

Example G2M

Each mole of Emulsion G was optimally sensitized with 0.97 mmole SD1 and 0.24 mmole of SD2 green sensitizing dyes, and with 2.6 mg of Compound 1 and 2.5 mg of gold sensitizer A1.

Example Emulsions G1M and G2M were coated in magenta format 2. The sensitometric comparison of Emulsion G1M to Emulsion G2M is given in Table 7.

TABLE 7

Speed, Fog, and Contrast Normalized Granularity Response for Emulsion G

| Example | Fog | Δ Speed | Rel. Gran. |
|---|---|---|---|
| G1M | 0.13 | check | check |
| G2M | 0.13 | −1 | −0.7 |

The comparison of Emulsion G1M to G2M demonstrates once again that no sensitivity increase was obtained by using a tetrasubstituted thiourea such as Compound 1 to sensitize tabular grain emulsions having an area weighted mean ECD less than about 3.7 μm.

In Examples A thru C cited above, the invention combination of a tetrasubstituted thiourea sensitizer and tabular emulsions having area weighted mean ECD greater than ot equal to about 3.7 μm provides a sensitometric advantage over emulsions sensitized with conventional thiosulfate sensitizers. This advantage for large tabular emulsions is unexpected in view of Examples D through G that show no sensitometric advantage for tabular emulsions having an ECD below 3.7 μm regardless of which type of sulfur sensitizer was used, as long as the conditions for each was independently optimized. The advantage can be seen as a combination of lower fog, higher speed, and/or less graininess.

APPENDIX

MC1

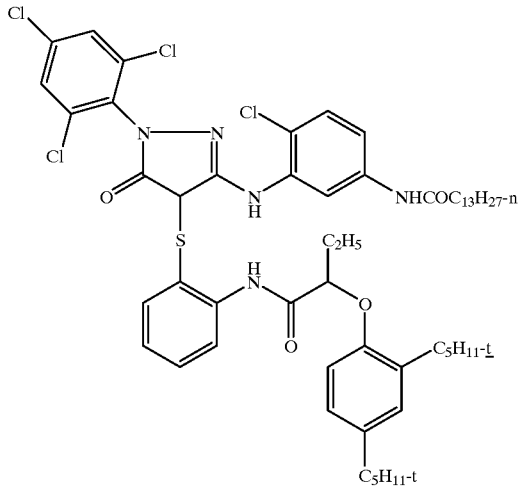

-continued

MC2

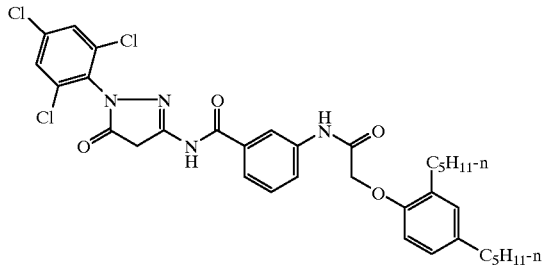

MC3

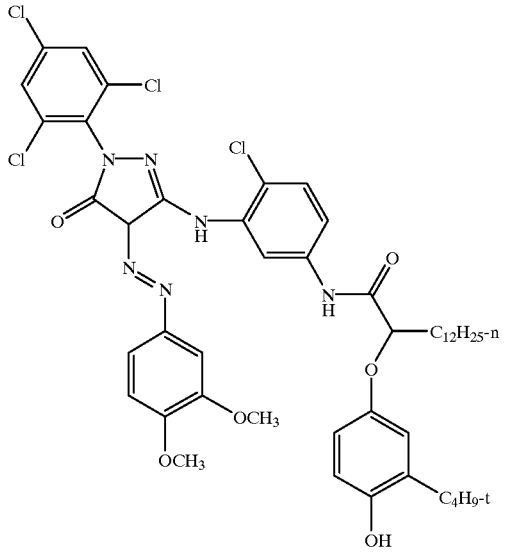

MC4

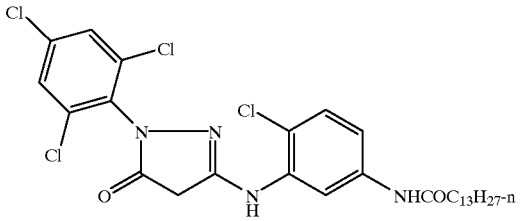

CC

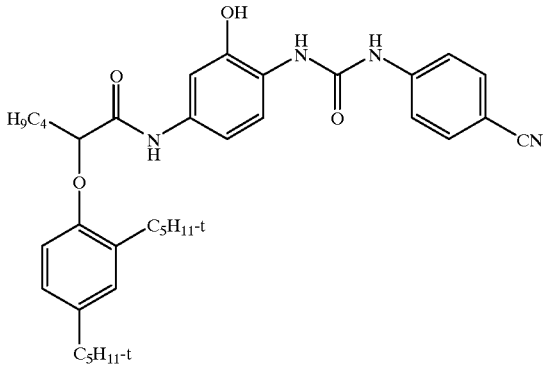

-continued

SD1

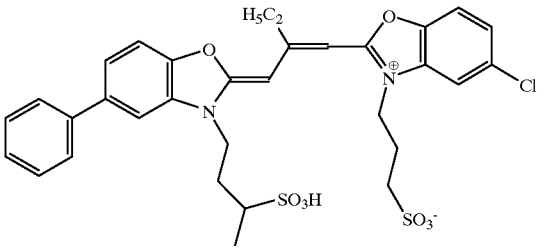

SD2

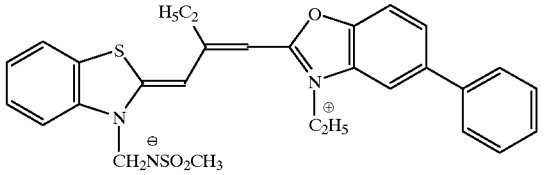

SD3

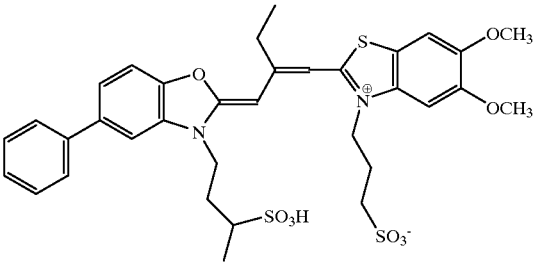

SD4

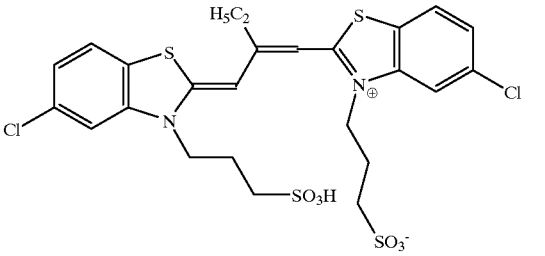

The invention has been described in detail with particular reference to certain preferred embodiments thereof, but it will be understood that variations and modifications can be effected within the spirit and scope of the invention.

What is claimed is:

1. An emulsion comprising non-epitaxy silver bromoiodide tabular grains of greater than or equal to about 3.7 $\mu$m area weighted mean equivalent circular diameter and thiourea sensitizer having the structural formula:

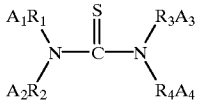

wherein each of $R_1$, $R_2$, $R_3$, and $R_4$ independently can represent an alkylene, cycloalkylene, carbocyclic arylene or heterocyclic arylene, alkarylene or aralkylene group; or taken together with the nitrogen atom to which they are attached, $R_1$ and $R_2$ or $R_3$ and $R_4$ can complete a 5- to 7-member heterocyclic ring; and each of $A_1$, $A_2$, $A_3$, and $A_4$ independently is hydrogen or represents a carboxylic, sulfinic, sulfonic, hydroxamic, mercapto, sulfonamido or primary or secondary amino nucleophilic group;

with the proviso that at least one of $A_1R_1$ to $A_4R_4$ contains a nucleophilic group bonded to a urea nitrogen atom through a 2- or 3-member chain and wherein said tabular grains comprise grains with a {111} major face.

2. The emulsion of claim 1 wherein said emulsion further comprises a gold sensitizer.

3. The emulsion of claim 1 wherein said emulsion comprises a gold sensitizer comprising a soluble gold(I) compound of the formula:

$$AuL_2^+X^- \text{ or } AuL(L^1)^+X^-$$

wherein

L is a mesoionic compound;

X is an anion; and $L^1$ is a Lewis donor ligand.

4. The emulsion of claim 3 wherein the gold(I) compound is:

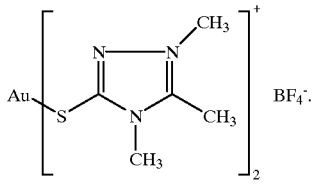

5. The emulsion of claim 3 wherein said silver bromoiodide grains comprise between about 1 and 6 mol percent of iodide.

6. The emulsion of claim 5 wherein said tabular grains have an area weighted mean equivalent circular diameter of between about 3.7 and about 10 $\mu$m.

7. The emulsion of claim 6 wherein said thiourea is present in an amount between 0.005 and 0.02 mmol/mol silver.

8. The emulsion of claim 7 wherein said gold sensitizer is present in an amount between about 0.0005 and 0.02 mmol/mol silver.

9. The emulsion of claim 3 wherein said thiourea is present in an amount between 0.001 and 0.1 mmol/mol silver.

10. The emulsion of claim 3 wherein said gold sensitizer is present in an amount between about 0.0001 and 0. 1 mmol/mol silver.

11. The emulsion of claim 1 wherein said thiourea sensitizer comprises

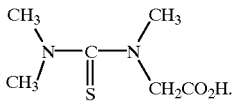

12. The emulsion of claim 1 wherein said thiourea sensitizer comprises

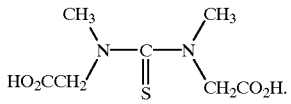

13. The emulsion of claim 1 wherein said thiourea sensitizer comprises

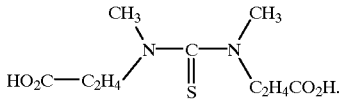

14. The emulsion of claim 1 wherein the thickness of said tabular grains is between about 0.03 and 0.4 μm.

15. The emulsion of claim 1 wherein the thickness of said tabular grains is between about 0.05 and 0.2 μm.

16. The emulsion of claim 1 wherein said thiourea is present in an amount between 0.0001 and 1 mmol/mol silver.

17. The emulsion of claim 1 further comprising a J-aggregating spectral sensitizing dye.

18. A photographic element comprising at least one emulsion comprising non-epitaxy tabular grains of greater than or equal to about 3.7 μm area weighted mean equivalent circular diameter and a thiourea sensitizer having the structural formula:

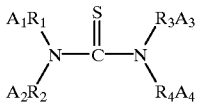

wherein each of $R_1$, $R_2$, $R_3$, and $R_4$ independently can represent an alkylene, cycloalkylene, carbocyclic arylene or heterocyclic arylene, alkarylene or aralkylene group; or taken together with the nitrogen atom to which they are attached, $R_1$ and $R_2$ or $R_3$ and $R_4$ can complete a 5- to 7-member heterocyclic ring; and each of $A_1$, $A_2$, $A_3$, and $A_4$ independently is hydrogen or represents a carboxylic, sulfinic, sulfonic, hydroxamic, mercapto, sulfonamido or primary or secondary amino nucleophilic group;

with the proviso that at least one of $A_1R_1$ to $A_4R_4$ contains a nucleophilic group bonded to a urea nitrogen atom through a 2- or 3-member chain and wherein said tabular grains comprise grains with a {111} major face.

19. The photographic element of claim 18 wherein said emulsion further comprises a gold sensitizer.

20. The photographic element of claim 18 wherein said emulsion comprises a gold sensitizer comprising a soluble gold(I) compound of the formula:

$AuL_2^+X^-$ or $AuL(L^1)^+X^-$ wherein

L is a mesoionic compound;

X is an anion; and $L^1$ is a Lewis donor ligand.

21. The photographic element of claim 20 wherein the gold(I) compound is:

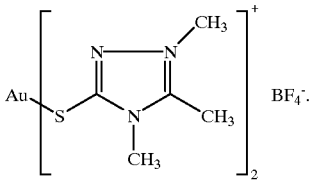

22. The photographic element of claim 20 wherein said thiourea is present in an amount between 0.0001 and 1 mmol/mol silver.

23. The photographic element of claim 22 wherein said gold sensitizer is present in an amount between about 0.0005 and 0.02 mmol/mol silver.

24. The photographic element of claim 18 wherein said thiourea sensitizer comprises

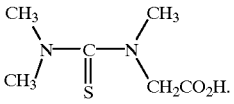

25. The photographic element of claim 18 wherein said tabular grains comprise bromoiodide.

26. The photographic element of claim 25 wherein said bromoiodide grains comprise between about 1 and 6 mol percent of iodide.

27. The photographic element of claim 18 wherein the thickness of said tabular grains is between about 0.05 and 0.2 μm.

28. The photographic element of claim 18 wherein said tabular grains have an area weighted mean equivalent circular diameter of between 3.7 and about 10 μm.

* * * * *